United States Patent [19]

Baummer

[11] 4,120,783

[45] Oct. 17, 1978

[54] APPARATUS AND PROCESS FOR ORDINARY AND SUBMARINE MINERAL BENEFICIATION

[76] Inventor: George P. Baummer, 25 Strabane Ct., Baltimore, Md. 21234

[21] Appl. No.: 812,460

[22] Filed: Jul. 5, 1977

[51] Int. Cl.[2] ..... B03B 5/02

[52] U.S. Cl. ..... 209/18; 209/210; 209/446; 209/496

[58] Field of Search ..... 209/160, 161, 210, 211, 209/437, 443, 445, 446, 453, 489, 491, 496, 18

[56] References Cited

U.S. PATENT DOCUMENTS

| | | | |
|---|---|---|---|
| 1,456,563 | 5/1923 | Noriega | 209/161 |
| 2,442,522 | 6/1948 | Wiegand | 209/161 X |
| 2,484,203 | 10/1949 | Beck | 209/446 |
| 3,537,581 | 11/1970 | Baummer | 209/437 |
| 3,595,385 | 7/1971 | Duff | 209/160 X |

*Primary Examiner*—Frank W. Lutter

*Assistant Examiner*—Ralph J. Hill

*Attorney, Agent, or Firm*—Newton, Hopkins & Ormsby

[57] ABSTRACT

The apparatus includes a fluid-tight housing oscillated about a vertical axis, the housing containing a central deflector separating the housing into an upper chamber and a lower chamber. Baffles are provided in both chambers, above and below the deflector. The upper baffle directs the incoming slurry radially outwardly in a torical path, throwing the particulate material toward a periphery of the housing in the first separation zone, in a gravity induced flow, through the annular passageway into the lower hopper where the relatively lighter and heavier constituents are then separated and separately discharged from the housing. A ring dam formed in the second baffle provides a recess into which the lighter constituents overflow where they are reunited with the liquid flow path and thus discharged from the housing.

47 Claims, 8 Drawing Figures

APPARATUS AND PROCESS FOR ORDINARY AND SUBMARINE MINERAL BENEFICIATION

An aspirator removes air automatically from the top of the chamber. The method carried out by the apparatus is claimed.

In a second embodiment the slurry is introduced tangential in the upper chamber and radial paddles or baffles arrest the whirlpool thus created, so that during the first portion of operation the slurry is subjected to centrifugal action and subsequently to settling action.

In other forms of the invention, recirculating closed systems are provided for recirculating the fluid medium. Also, the flow rates of the fluids and solids or particulates are independently adjustable by various means. The slurry is formed from fluid particulate material. Either gas (air) or liquid (water) is used as the fluid medium and finely divided solids such as gold ore is used as the particulate material.

BACKGROUND OF THE INVENTION

1. Field of the Invention

This invention relates to a mineral benefication device and process and is more particularly concerned with a method and apparatus for Ordinary and Submarine Mineral Beneficiation for the separation and concentration of particulate material from a fluid slurry.

2. Description of the Prior Art

Heretofore, particulate materials of diverse specific gravities carried in a fluidic medium were generally separated and concentrated through the use of sloping particle separators such as those dating back to the ancient riffle sluices to the more recent undercut sluice types including the spiral, the cone, the Lamflo concentrator and the undercut sluice tray. Such devices, which are exemplified by those disclosed in U.S. Pat. Nos. 1,291,137, 1,986,179 and 2,989,184, were so constructed as to be open to ambient atmospheric pressure. When these devices were used in placer mining and beneficiation of milled ores their operational efficiencies were limited, particularly in the separation and concentration of particulates of fine size, by the presence of surface turbulence and the necessity of maintaining a single flow rate through the entire separation circuit during processing. In these prior art devices this single flow rate had to be maintained at a velocity sufficient to transport all the particulate material being processed through the entire process circuit and therefore at such a flow velocity that there was a tendency to retain the very finest particles, in suspension. Also, in these devices the fluid carrier transport flow rate was inseparable from the particulates flow rate.

Particulates flow rate determines exposure time of the particulates at the point of selective separation when passing through the process circuit, and these prior art devices had no means to adjust particulates flow rate, i.e., exposure time, independently from the fluid carrier flow rate.

Indeed, these prior art devices had no means to readily adjust the proportional division and discharge from the uppermost strata and from the lowermost strata of the particulates being processed. These devices operated with a substantially fixed enrichment ratio usually necessitating successive processing stages to achieve an acceptable concentration of the relatively heavier mineral from an ore feed. As a part of their operation, a middlings product was usually generated by these devices, the product requiring recycling and additional material handling. Also, with these prior art devices, the feed density, i.e. the ratio of particulates to the fluid carrier, was a critical factor in the efficiency of the separating process and had to be maintained within close tolerances. For example, with some of these devices the feed density was recommended to be maintained within 5% limits. Furthermore, these prior art devices had no adjustable means to readily respond to a feedback signal to optimize process performance, nor were the general flow paths of the fluidic medium and the particulates separable.

To eliminate some of these undersirable features, a closed-chamber type separator was recently developed as disclosed in U.S. Pat. No. 3,537,581. Upon entering such a chamber through an inlet passage the flow rate of material was reduced and dissipated in a substantially larger space thereby creating a controllable factor capable of dictating the fallout pattern of the solid particulate material carried by the fluidic medium. Within the chamber, a partial separation of the fluid flow path and the solid flow path was achieved. The solid material, having fallen from a suspension in the fluidic medium as a result of the reduced flow rate, followed a gravity-directed path through a processing area that was operated under relatively smooth, laminar flow conditions, substantially void of surface turbulence.

Though the just described closed-chamber type separators have produced a decisive advance in the art of separating particulate materials, they have been lacking in certain respects.

For example, these devices have typically required intermittent suspensions of operations in order to recover the separated material. Input and discharge of particulates has not been automatically controlled. Gas blockage has frequently limited performance. Near complete separation of particles from the fluidic medium has not been achieved. Particulates flow rate has not been controlled independently from fluid flow rate and the proportional division and discharge from the uppermost strata and from the lowermost strata of particulates, being processed, has not been controlled.

The prior art closed chamber type separators have had no provisions for continuous operation of the process in a manner that would exempt the process from a fixed enrichment ratio; nor do they have provisions for continuous operation of the process with the elimination of a middlings product.

Feed density, as a critical factor in the operating efficiency of the prior art closed chamber process, has not been eliminated to any substantial extent nor have such prior art devices provided adjustable means to readily respond to a feed back signal to optimize process performance.

No means were provided to accommodate centrifugal delivery of particulates into the closed chamber.

Accordingly, it is a general object of the present invention to provide improved apparatus and process for separating and concentrating particulate materials which will overcome the disadvantages described above.

More specifically, it is an object of the present invention to provide an apparatus of the closed-chamber type for separating and concentrating particulate materials with improved operational performance for both ordinary and submarine applications.

Another object of the present invention is to provide an apparatus of the type described which is capable of purging gases trapped within the closed chamber.

Another object of the present invention is to provide apparatuses of the type described with automatic control means for controlling the delivery of material into the closed chamber and also discharge of material from the chamber as dictated by conditions within the chamber.

Another object of the present invention is to provide an apparatus and process for separating particulate material, which is capable of operation under water and is thus suitable for use on an ocean bed.

Another object of the present invention is to provide an apparatus and process for separating particulate material in which the surface turbulence of the particulate flow is eliminated, thereby preventing further disintegration of the particles which are to be separated.

Another object of the present invention is to provide an apparatus and process for separating particulate material which will eliminate the necessity of maintaining a constant flow rate through the entire process.

Another object of the present invention is to provide an apparatus and process for separating particulate material which can operate in a plurality of stages, the material being fed from one stage to the next automatically.

Another object of the present invention is to provide an apparatus and process for separating particulate material wherein particles, which are carried by a slurry when separated from the fluid thereof, are directed along separate paths from that of the fluid.

Another object of the present invention is to provide an apparatus and process for separating particulate material in which the flow rate of the fluid and the flow rate of the particles separated from the fluid can be individually adjusted and controlled, as desired.

Another object of the present invention is to provide an apparatus and process for separating particulate material wherein the time in which the particles are subjected to a separating force can be varied, as desired.

Another object of the present invention is to provide an apparatus and process for separating particulate material wherein the operation of the apparatus and process is automatically controlled.

Another object of the present invention is to provide an apparatus and process for separating particulate material in which the rate of input of the particles into the area of selective separation is controlled automatically by the rate of withdrawal of material from this area.

Another object of the present invention is to provide an apparatus and process for separating particulate material in which the discharge of the separated particles can be intermittent or continuous, as desired.

Another object of the present invention is to provide an apparatus and process for separating particulate material wherein a slurry containing the particulate material is subjected to a plurality of separating procedures and wherein the time in which the slurry is subjected to each operation can be varied, as desired.

Another object of the present invention is to provide an apparatus and process for separating particulate material wherein the material may be separated at an intermediate stage in the process, if desired.

Another object of the present invention is to provide an apparatus and process for separating particulate material in which the enrichment ratio of the resulting particulate material may be varied, as desired.

Another object of the present invention is to provide an apparatus and process with a means to readily adjust the proportional division and discharge from the uppermost strata and from the lower most strata of the particulates being processed.

Another object of the present invention is to provide an apparatus and process for separating particulate material in which a middling product is eliminated.

Another object of the present invention is to provide an apparatus and process for separating particulate material wherein the heavy constituents of a slurry may be effectively recovered, regardless of the feed density of the slurry.

Another object of the present invention is to provide an apparatus and process for separating particulate material wherein the maximum capacity of the apparatus and process can be readily and easily determined.

Another object of the present invention is to provide an apparatus and process for separating particulate material which, while utilizing a fluid, such as water, is incorporated into a closed system in which no appreciable additional water is required.

Another object of the present invention is to provide an apparatus and process for separating particulate material wherein the material may be readily and easily recycled, in the event more definite separation of the material is desired.

Other objects, features and advantages of the present invention will become apparent from the following description when taken in conjunction with the accompanying drawings, wherein like characters of reference designate the corresponding parts throughout the several views.

DESCRIPTION OF THE PREFERRED EMBODIMENTS

Figure 1:
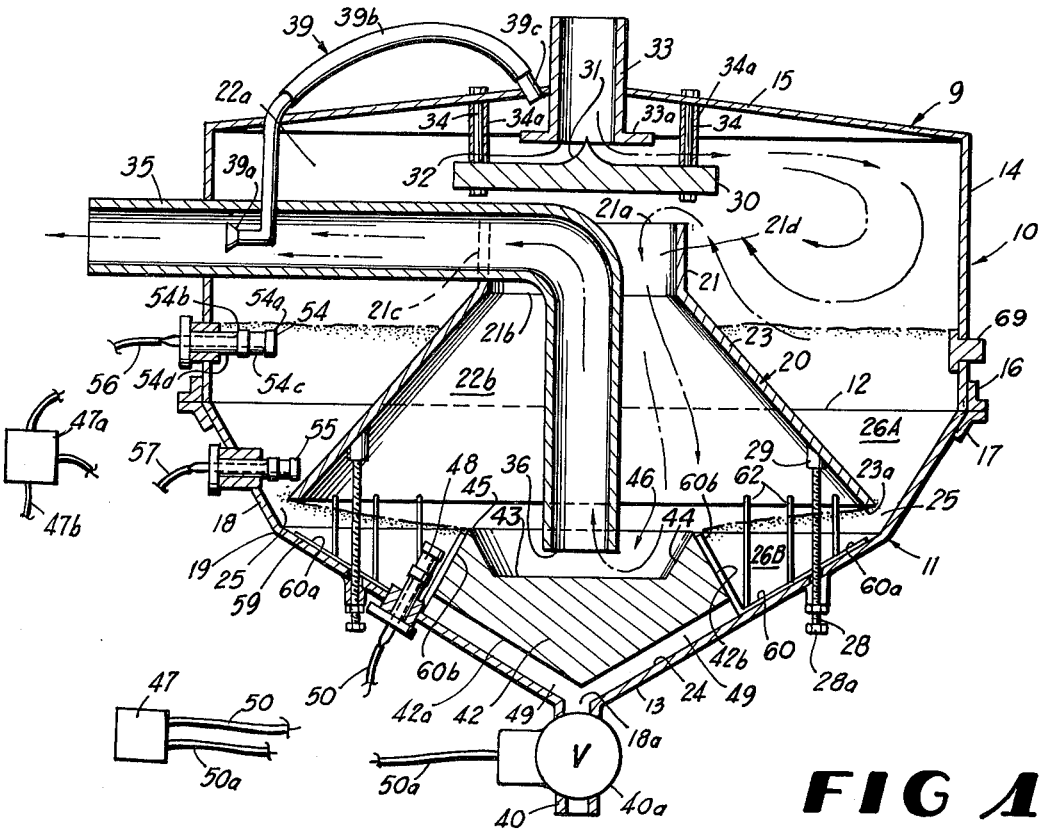
FIG. 1 is a vertical sectional view, of a particulate material separating and concentrating apparatus embodying principles of the present invention.

Referring now in more detail to the drawing, there is shown in FIGS. 1–4 solids or particulate material separating and concentrating apparatus comprising a fluid-tight housing 9 having an upper housing portion or casing 10 detachably connected to a lower housing portion or casing 11 along a horizontal plane 12. The upper housing portion 10 includes a cylindrical side wall 14 closed at the upper end by a conical upwardly tapered, top wall 15. A circumferential flange 16 is mounted radically along the lower end of side wall 14 and abuts a flange 17 mounted to the upper edge of a frusto-conical side wall 18 of lower housing portion 11. Unshown connecting means detachably hold the two flanges 16 and 17 together for detachably connecting the upper and lower portions of the housing 9. Housing 9 is generally symmetrical about its vertical axis $\alpha$.

In more detail, the lower casing 11 or portion, as seen best in FIG. 1, includes a conical bottom portion or wall 13 integrally joined along a common edge 19 to the upper side wall 18. The upper edge of the sidewall 18 carries the flange 17. The wall 18 tapers conically downwardly and inwardly from flange 17 and the conical bottom wall 13 converges downwardly and inwardly at a less slope than the slope of wall 18. The lower apex of bottom portion terminates at axis $\alpha$ in a particulate discharge port 18*a*.

It is thus seen that the elements described above, namely side wall 14, top wall 15, side wall 18, bottom wall 13 and flanges 16 and 17 of housing 9 are concentric about the vertical axis $\alpha$ and there edges, namely edges 12 and 19, are disposed on radial horizontal planes parallel to each other.

As best seen in FIG. 1, a hollow, upright, tubular frusto-conical deflector 20 is disposed concentrically within the interior of the housing 9. The upper end portion of deflector 20 includes a hollow, tubular cylindrical neck 21 which is open at both its upper end edge or lip 21*a* and its lower end of edge 21*b* and has a central vertical passageway 21*d*. The lower end 21*b* is integrally joined to the upper circular edge of the frusto-conical body or skirt 23 of deflector 20 to form a common edge. The skirt 23 flares or diverges downwardly and outwardly from the neck 21 and terminates at its lowermost portion in a circular peripheral edge 23*a*, disposed in a radial plane. Edge 23*a* terminates in spaced relationship to the inner downwardly converging wall 18 to define an annular passageway 25.

It is now seen that the deflector 20 separates the chamber of the housing 9 into an upper chamber 22*a* with a particulates hopper 26*a* and a lower chamber 22*b*, with a particulates hopper 26*b* in communication with each other through the annular passageway 25 and through the central passageway 21*d*, defined by the hollow neck 21 and skirt 23 of the deflector 20. Lower hopper 26*b* is more specifically defined as being bound on the periphery by the lower portion of wall 18 to an elevation abutting annular passageway 25 and on the inner boundary by deflector 42 to the elevation of spillway lip 45. The upper boundary is the adjustable diagonal between annular passageway 25 and spillway lip 45. The lower boundary on the periphery is the junction of wall 18 and bottom wall 13 and on the inner boundary, bottom wall 13 at its junction with passageway 49.

The function of upper chamber 22*a* is to separate the liquid carrier flow path from the particulate material flow path and also to provide an internal particulate material feed hopper 26*a* which is directly coupled through annular passageway 25 to second stage lower particulate material hopper 26*b* in lower chamber 22*b*. Separation of the liquid from the particulate material, and thus their flow paths, is accomplished through a combination of centrifugal action, dissipated flow rate and gravitational settling that separates the bulk of particulate material from the primary flow path of the liquid, causing the particulate material to fall from suspension and settle into the upper hopper 26*a* which is generally defined by skirt 23 on the inner boundary, walls 14 and 18 on the periphery to an elevation of sensor 54 and having a lower boundary, passageway 25. Having dropped the bulk of particulate material that it carries into housing 9, the liquid flow path is directed through central passageway 21*d* since annular passageway 25 is blocked to liquid flow by an accumulation of particulate material. Liquid flow rate through this area can be adjusted to leave only microscopic particles or undesirable slime in suspension and thus carry these detriments directly through the process chamber to discharge. The second stage lower hopper 26*b* in chamber 22*b* forms a second separation zone in which separation of the heavy constituents from the lighter constituents of the particulate material takes place.

Passing through the second separation zone and isolated from the liquid flow path, particulate material is in a gravity induced flow path, having entered through annular passageway 25 from its temporary storage in upper hopper 26*a*. Through this second separation zone the flow rate of particulate material is adjusted independently from the liquid flow rate as it is also subjected to a stratification aeration in which the heaviest constituents can be withdrawn separately from the lighter constituents. The lighter constituents, after completing their pass through the second separation zone, second stage hopper 26*b*, are then reunited with the liquid flow path as they spill over into recess 46 and thus discharge from housing 9 separately from the heavier constituents. This will be explained more fully hereinafter.

The deflector 20 is supported by a plurality of upstanding bolts 28 which are threadedly received through the bottom 13, these bolts 28 being circumferentially spaced around axis $\alpha$ in parallel relationship to each other. The bolts 28 have lower heads 28*a* which are externally of the housing 9. The upper ends of the bolts 28, however, terminate within the casing 11 in a common transverse or radial plane, the upper ends being respectively received in and journalled by circumferentially spaced bearing blocks 29. The bearing blocks 29 are secured to the inner surfaces of the skirt 23, inwardly of and above the peripheral edge 23*a*. It is thus seen that, by manipulation of the screws 28, the deflector 20 may be incrementally raised and lowered changing its relative position or descent angle to spillway lip 45 and thus providing a course adjustment for the flow rate of particulate material through lower hopper 26*b*. Increasing or decreasing stimulation of gravity induced flow of particulate material by varying the oscillation or agitation applied to housing 9 provides a fine adjustment of the particulate material flow rate through lower hopper 26*b*.

In the upper chamber 22*a*, along the axis $\alpha$, is a radially disposed upper baffle or plate 30, the function of which is to direct the incoming slurry, consisting of fluid medium and suspended particulate material, radially outwardly within the first stage separation zone or chamber 22*a*. The upper baffle 30 is a flat, disc-shaped member concentrically disposed in casing 10, the baffle 30 being suspended from top wall 15 by circumferentially equally spaced bolts 34.

In more detail, the bolts 34 pass through circumferentially spaced holes in the top wall 15 and through corresponding holes in baffle 30, the shanks of bolts 34 receiving, respectively, spacer sleeves 34*a* which rigidly position the baffle 30 in place. By replacement of the bolts 34 and sleeves 34a the vertical position of the baffle 30 can be varied up or down, as desired.

At the upper central portion of baffle 30, along axis α, is an upstanding curved conical projection 31. This projection 31 is in axial alignment with the downwardly opening discharge mouth or exit opening 32 of an intake or feed conduit 33 which protrudes along axis α coaxially downwardly through and is carried by the central portion of top wall 15. The inner end of conduit 33, defining mouth 32, terminates within the upper chamber, or separation zone 22a and is provided with a radially disposed peripheral flange 33a spaced above and parallel to the upper surface of baffle 30. The outer end of conduit 33 terminates outwardly of the top wall 15 and receives thereon a flexible infeed hose 38, seen in FIG. 3. The function of flexible hose 38 is to feed the slurry into the housing 9, through conduit 33.

The slurry is preferably fed under pressure and at a sufficient velocity that when the slurry is introduced axially downwardly into the upper casing 10, the slurry engages the upper baffle 30 and is directed radially outwardly in all directions, as shown by arrows in FIG. 1, into the upper chamber or separation zone 22a.

If desired, the intake pipe or conduit 33 can be loosely retained by top wall 15 so that the housing 9, can be oscillated about axis α without disturbing the conduit 33. If, however, the conduit 33 is fixedly secured to wall 15, as illustrated, the flexibility of hose 38 is sufficient to permit oscillation about axis α.

Various control means, such as pump 310 in FIG. 7 can be employed to control the volume and velocity of the feed slurry, and subsequently the liquid through its isolated flow path. Also in a gravity operated mode as shown in FIG. 8 the rate of flow can be controlled by the discharge as described hereinafter.

The baffle 30 is of substantially smaller diameter than the diameter of its concentric side wall 14 but is of larger diameter than the mouth 32. The baffle 30 is concentric to and spaced above the neck 21 in spaced relationship to the upper end of lip 21a to allow for adjustment of deflector 20. Hence, the return liquid flow can readily pass between lip 21a and the bottom surface of baffle 30 and, thence, into the axially disposed central passageway 21d of the neck 21 and skirt 23. The inside diameter of the central passageway 21d preferably is larger than the diameter of conduit 33 so that a free flow of liquid can be handled.

Figure 3:
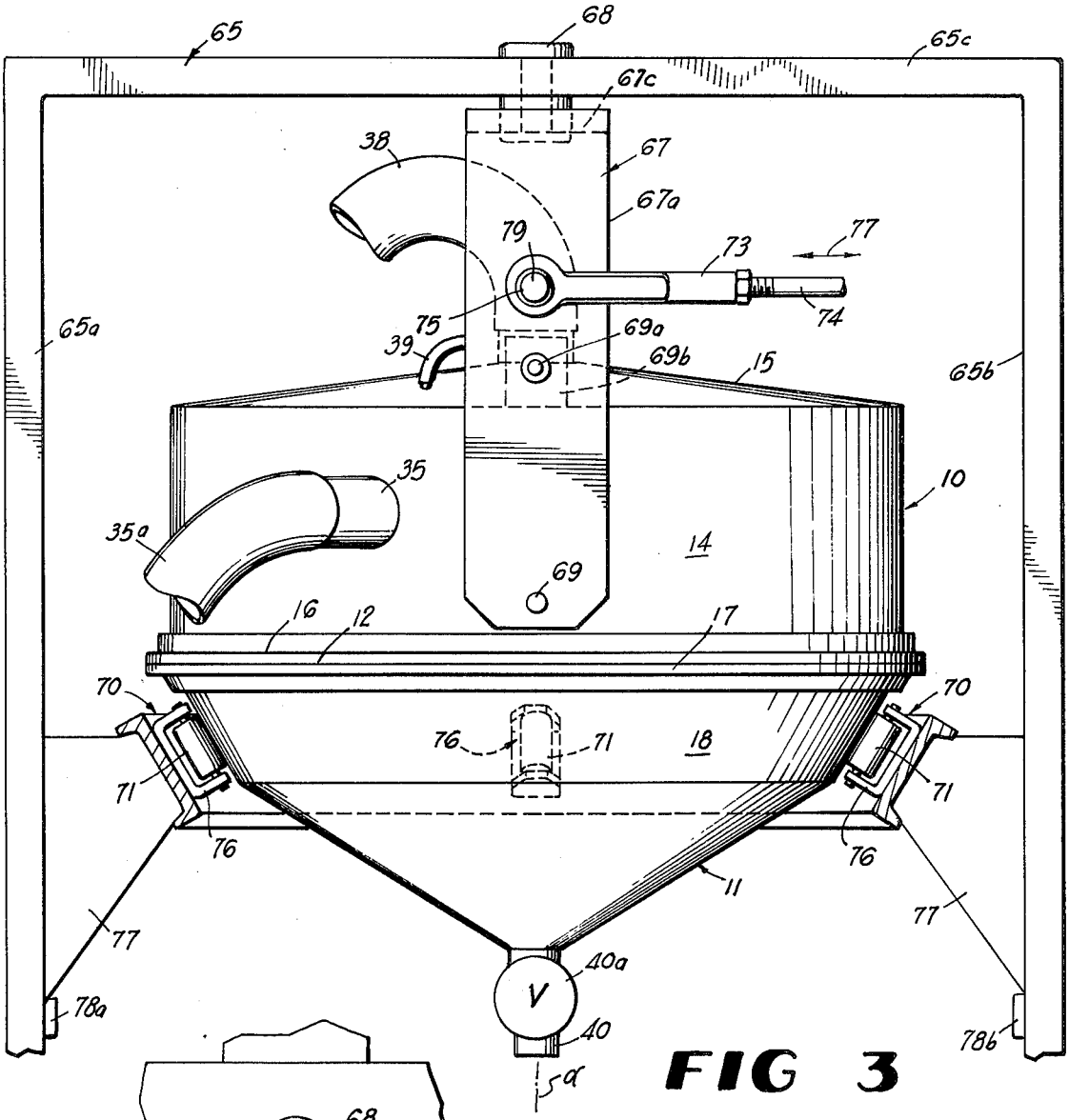
FIG. 3 is a side elevational view of the exterior of the apparatus shown in FIG. 1, the apparatus being supported by a frame structure for rocking or oscillatory movement.

The effluent (slurry discharge) of the system is withdrawn through an L-shaped eduction tube or discharge conduit 35, one leg of which extends axially or vertically along axis α and the other leg of which extends horizontally or radially and unattached through an upwardly open U-shaped recess 21c in the neck 21 and, thence, outwardly through the side wall 14 so that its outer end, outwardly of the side wall 14, receives a flexible discharge hose 35a, shown in FIG. 3.

The axially disposed leg of the L-shaped conduit 35 is of smaller diameter than passageway 21d and extends downwardly from the inner end of its associated leg to terminate in a downwardly opening mouth or intake opening 36, below the lowermost edge of peripheral edge 23a of skirt 23 but well above the bottom surface 24 of bottom wall 13. Substantially all liquid and the lighter constituents of the slurry are withdrawn through this eduction tube or discharge conduit 35, being discharged through flexible discharge hose 35a.

It will be understood by those skilled in the art that, by the introduction through conduit 33, into upper chamber or separation zone 22a of a slurry, in which particulate material is suspended, the particulate material having various specific gravities greater than the liquid in which it is entrained, a separation of the liquid and the particulate material is caused to take place. This is because the slurry is caused to travel in a torical path radially outwardly and then inwardly in the large upper chamber 22a. The effect of such movement is two fold. First, due to centrifugal force, the particulate material is thrown outwardly toward the side wall 14 and, secondly, the decrease in velocity causes the particulate material to be dropped out of suspension from the liquid flow path.

Generally speaking, the size of the upper chamber or separation zone 22a and the velocity of the slurry, as well as the various specific gravities of the particulate material will determine the efficiency of this first stage separation.

It is usually desirable to control the flow rate into chamber 22a so as to permit the liquid of the slurry to retain, in suspension, only microscopic particles or slimes, while flinging out and dropping out by gravity the bulk of particulate material.

The bulk of particulate material thus collects in upper hopper 26a along the walls 14 and 18 and against the skirt 23 of deflector 20, is thence directed by the downwardly converging surfaces of the wall 18 and the skirt 23 toward the annular passageway 25. The microscopic particles or slime, however, remain in suspension and are carried up and over the lip or upper edge 21a and into passageway 21d.

Within the lower chamber, or second separation zone 22b is a second or lower baffle or deflector block, denoted generally by numeral 42. This baffle 42 is concentrically located along axis α and has a downwardly converging conical, bottom surface 42a and an upwardly converging frusto-conical side wall 42b. The upper edge of the upwardly converging conical wall 42b terminates at an upper annular edge or lip 45 disposed in a horizontal radial plane normally spaced below the radial plane of peripheral edge 23a. Lip 45 is aligned in a common plane with edge 19.

The upper portion of lower baffle 42 has a central cup-like recess 46, defined by a flat planar radially disposed upper central surface 43 and a conical, upwardly diverging dam wall 44. Thus, walls 42b and 44 converge upwardly to define the arcuate, annular ring dam or spillway having an upper lip or edge 45 in a radial plane and over which spill the lighter constituents into recess 46 from lower hopper 26b upon oscillation of the housing and lower baffle 42.

Between the radially extending portion of discharge pipe 35 and the top of chamber 22a is an aspirator 39 including a venturi tube 39a disposed within the radial portion of pipe 35. The tube 39a has a funnel shaped mouth, disposed along the axis of conduit 35, the mouth diverging in the direction of flow. The body of the tube 39a is L-shaped and passes outwardly through the side of conduit 35 and then through top wall 15 to terminate outside the housing 9.

The aspirator 39 also includes a flexible hose 39b leading from the protruding end of tube 39a to a stub tube 39c, the stub tube 39c passing through top wall 15 adjacent conduit 33.

Upon the flow of fluid i.e., liquid through conduit 35, a suction will be drawn by aspirator 39 so as to withdraw air from the uppermost part of chamber 22a and entrain the air in the effluent.

Returning now to the lower baffle 42, it is understood that the upper surface 43 of the recess 46 is disposed immediately below the mouth 36 of the education tube or discharge conduit 35. Hence, the substantially isolated liquid flow path passes through passageway 21*d* in neck 21 and skirt 23 thence downwardly in a generally axial direction, into the recess 46 of baffle 42 then makes an abrupt 180° turn to enter, upwardly, into the mouth 36. Mouth 36 is positioned to pick-up and discharge through conduit 35 all particulate material that has entered into recess 46 past spillway lip or edge 45.

Oscillation or agitation of the particulate material in the lower hopper 26*b* both stratifies the particulate material according to their relative weights and also stimulates the gravity induced flow of particulate material through this area. The flow path of particulate material through the lower hopper 26*b*, begins with its entrance by way of passageway 25 which is a direct coupling between upper particulates hopper 26*a* in chamber 22*a* and the lower hopper 26*b*. The particulate material in a gravity induced flow moves to either of two exits, past spillway lip 45 into recess 46, which is a discharge means from the upper strata of particulate material, or through passageway 49 which is a discharge means from the lower strata of particulate material. The adjustable output from the lower strata by way of passageway 49, part 18*a*, and valve 40*a* provides a readily adjustable means for the proportional division and discharge from the upper strata and from the lower strata of the particulate material being processed. Also, with the direct coupling, passageway 25, between the stacked stage hopper 26*a* and the second stage hopper 26*b*, particulate material is transferred from the first stage hopper into the second stage hopper equal in amount and at a rate to correspond to the total particulates discharge from the second stage hopper.

The diameter of the lower baffle or deflector block 42 is about one-half the diameter of bottom wall 18 and the lip or rim 45 terminates in about the same plane as edge 19.

Figure 2:
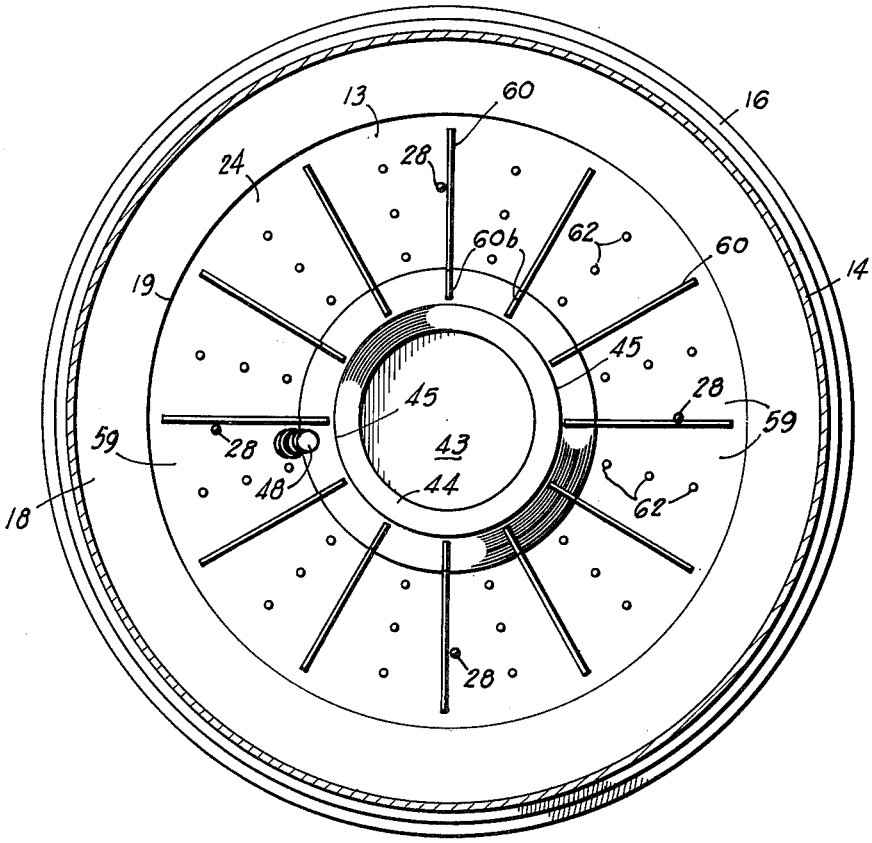
FIG. 2 is a cross-sectional view of a bottom portion of the housing of the apparatus shown in FIG. 1, and discharge conduit and skirt being removed for clarity.

The baffle 42 is supported, in spaced relationship to the bottom surface 24, by a plurality of L-shaped bars which form circumferentially spaced riffles 60, best seen in FIG. 1 and FIG. 2. In cross-section the riffles are rectangular. Thus, the opposed spaced conical surfaces 24 and 42*a* form a conical downwardly converging discharge passageway 49 for feeding the heavy particulate material toward port 18*a*.

One arm 60*a* of each riffle 60 extends radially along surface 24, outwardly of passageway 49. The other arm 60*b* projects along the side wall 42*b* of baffle 42. Thus, the riffles 60 define, with surface 24, an array of circumferentially spaced, upwardly open, and downwardly and inwardly inclined, or sloping, inwardly converging channels 59, in an annular array around the passageway 49, each of which feeds the particulate material toward the passageway 49, upon oscillation of the housing 9.

Upstanding agitation rods, pegs or fingers 62 are provided in each sloping channel 59. Preferably these rods 62 are disposed in spaced radial alignment midway between riffles 60. These vertical rods 62 terminate in a common radial, horizontal plane above the plane of lip 45 and within skirt 23.

The discharge port 18*a* communicates with an axially disposed discharge pipe or conduit 40 provided with a remotely controlled, incrementally opening, electromechanical valve, such as a solenoid gate valve 40*a*. The incremental opening and closing of valve 40*a* is remotely controlled through appropriate electrical controls 47 and cable 50*a* which, in turn, is connected to a sensor 48 via wires 50. Sensor 48 protrudes up through bottom wall 13 adjacent to wall 42*b*.

It will be understood that the heavy metals, such as gold and lead, are unusually good electrical conductors. Therefore, as the density of the heavy constituents builds up, the electrical resistance between the electrodes of sensor 48 will progressively drop. The control 47 is set to open and close valve 40 or vary the amount by which the valve 40*a* is opened or closed, in response to this detected resistance. The control 47 may be set to open valve 40*a* when the sensor detects a very low resistance so that the heavy constituents are subjected to a long exposure time or period of stratification (oscillation) whereby only the heaviest constituents are passed through valve 40*a* or the control 47 can be set for opening valve 40*a* at a higher resistance whereby less stratification will have taken place. Other known means of density sensing can also be used to perform this function.

As seen in FIG. 1, the lower portion of wall 14 carries an upper limit sensor 54, and the middle portion of wall 18 carries a lower limit sensor 55. Each of sensors 48, 54 and 55 is identical in construction, having two, disc-shaped, aligned electrodes, such as electrodes 54*a* and 54*b*, spaced apart by a dielectric wafer 54*c* and carried on the end of a dielectric shank 54*d*. Electrical wires 56 and 57 lead from the electrodes of sensors 54 and 55 to an electrical control 47*a*. Cable 47*b* leads to the particulate material infeed solenoid valve 304. When the sensor 54 is submerged in the accumulated particulate material the valve 304 is electrically closed.

Figure 9:
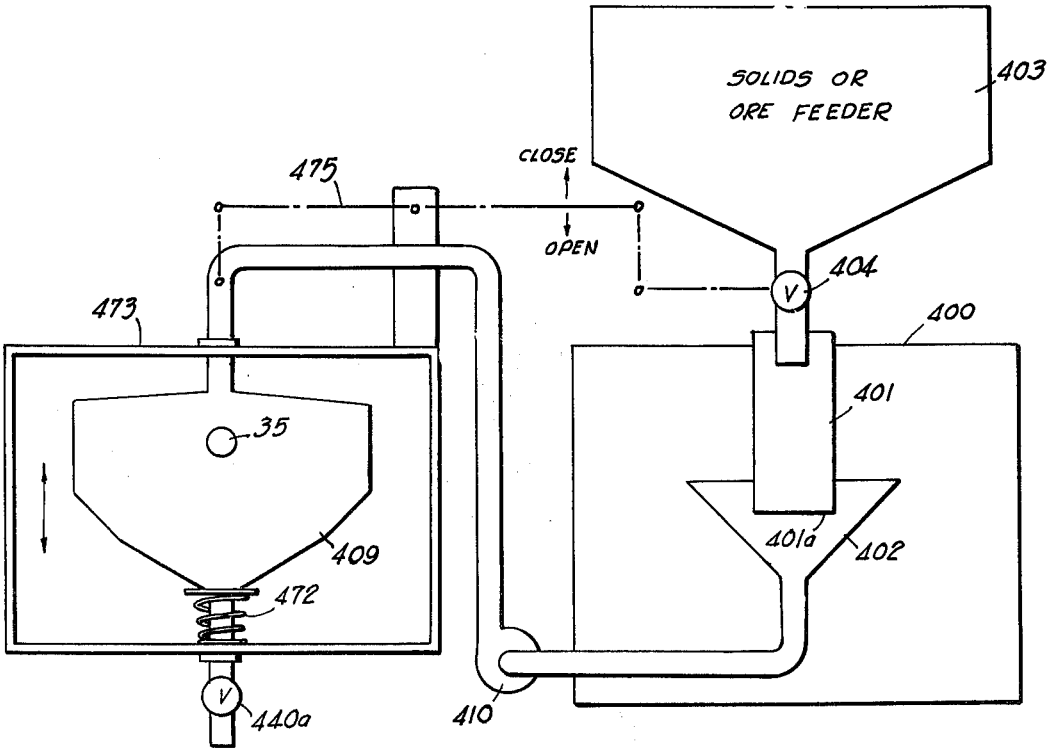
FIG. 9 is a schematic diagram of the present invention illustrating a direct mechanical coupling to control solids input.

The primary function of lower sensor 55, when not submerged in particulate material, is to signal a warning of insufficient accumulation of solids in upper hopper 26*a* for proper process operation. Particulate material feed rate into the process housing 9 is slightly greater than the capacity of the process circuit, thus the solids input regulated by sensors 54 and 55 provide a prescribed level of particulate material to be maintained in the first stage upper hopper 26*a* sufficient to block annular passageway 25 to liquid flow and at a level low enough so that the accumulated particulate material will not overflow into central liquid passageway 21*d*. As will be explained hereinafter, this prescribed level of particulate material can also be maintained through a direct mechanical coupling between a mechanical inlet valve much as inlet valve 404 and the housing 409 when the housing is mounted to have vertical compliance that will respond to the varying total weight of the housing 409 and its contents as illustrated in FIG. 9.

Referring now to FIG. 3, the gimble support for the housing is illustrated as including an inverted U-shaped primary frame 65 having spaced parallel upstanding standards or struts 65*a* and 65*b*. The upper ends of the standards 65*a* and 65*b* are joined by a horizontal, laterally extending, cross beam 65*c*.

Figure 4:
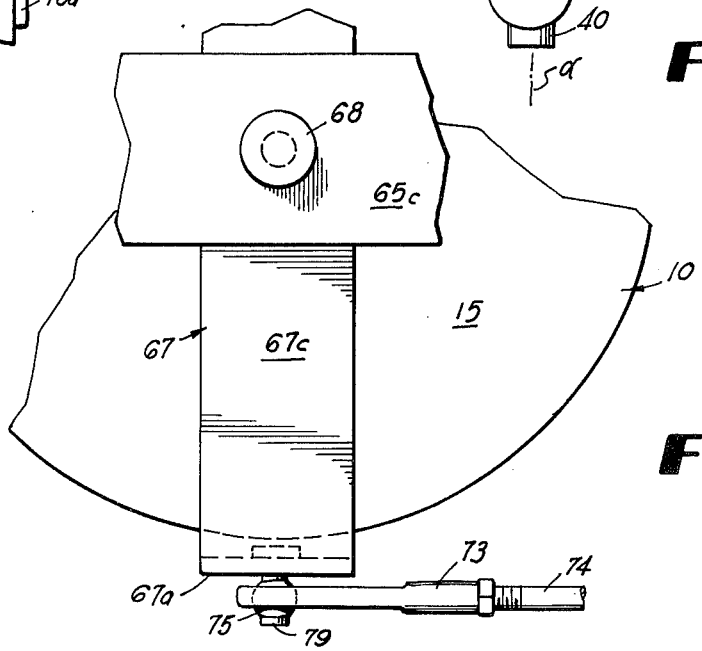
FIG. 4 is a fragmentary plan view of a portion of the apparatus illustrated in FIG. 3.

Below the cross beam 65*c* is a smaller inverted U-shaped bale or strap 67 having spaced, vertically, parallel arms 67*a* and 67*b* (not shown on drawing) the upper ends of which are joined by a horizontal cross bar 67*c* which extends beneath the central portion of beam 65*c*, as seen in FIG. 4. A pivot shaft 68 along axis $\alpha$ connects the midportions of beam 65*c* and bar 67*c*.

Trunions 69 which protrude from opposite sides of the housing 9, namely, casing 10, are received by the lower ends of arms 67*a* and 67*b*. Also, pins, such as pin 69*a*, and brackets, such as bracket 69*b*, secure the casing 10 to the arms 67*a* and 67*b* above the trunions 69.

For oscillating the strap 67 about axis α, a reciprocation rod 74 leading from a suitable prime mover, such as a crank (not shown) of a motor (not shown). The rod 74 is connected through a turn-buckle 73 and a self-aligning bearing 75 to a stub shaft 79 protruding from one arm 67*a*. Thus, when the rod 74 is reciprocated as indicated by arrow 77, the strap 67 will be rocked back and forth about pivot shaft 68 and vertical axis α.

The lower chamber 11 is supported for oscillation with chamber 10 by circumferentially spaced cylindrical rollers 71 carried by U-shaped brackets 76 on a support ring 70. Appropriate braces 77 extending from standards 65*a*, 65*b* support ring 70. The axes of rollers 71 are inclined to permit the outer surface of wall 18 to ride against the inner peripheries of the rollers 71.

Strain gauges 78*a* and 78*b* on standards 65*a* and 65*b*, respectively, function to weight the slurry within the housing, and in lieu of sensors 54 and 55, can provide the control signal to regulate the particulates level in upper hopper 26*a*.

Figure 5:
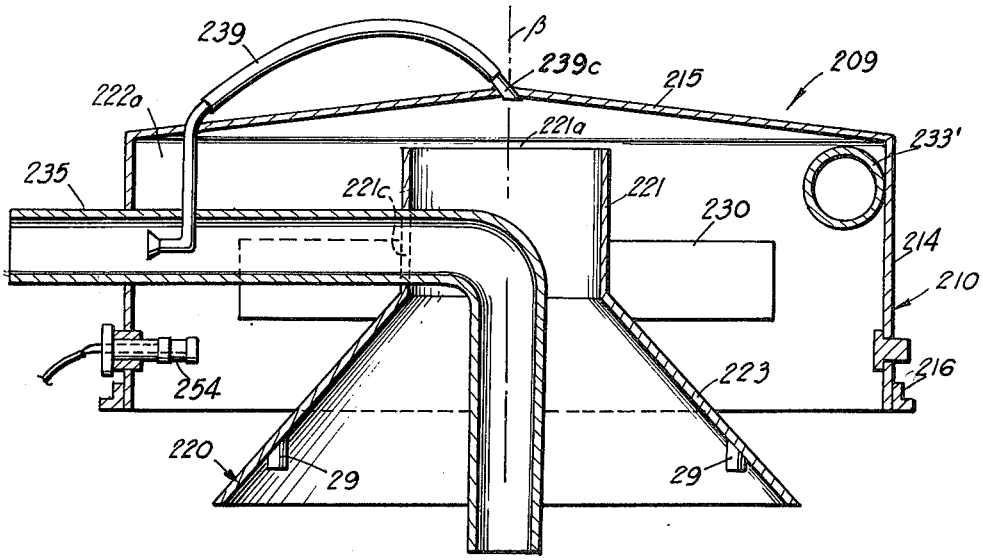
FIG. 5 is a vertical sectional view of an upper portion of the apparatus similar to the apparatus of FIG. 1, and depicting a modified form of the apparatus.
Figure 6:
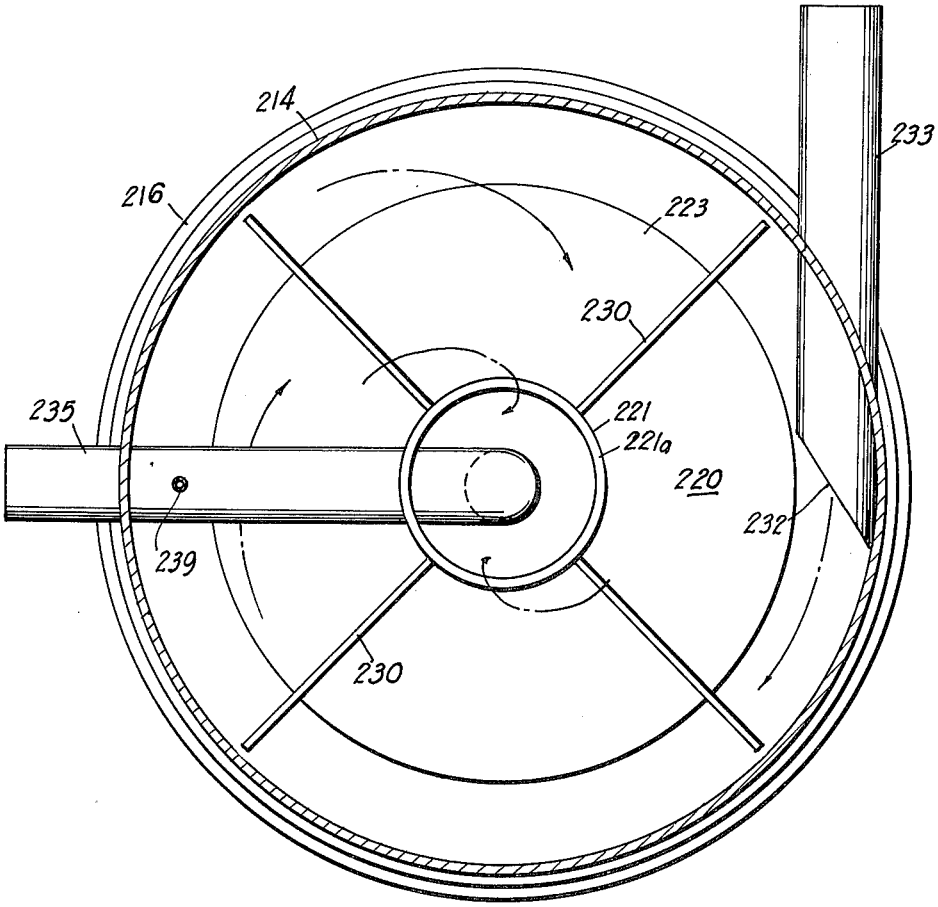
FIG. 6 is a cross sectional view of that portion of the apparatus shown in FIG. 5.

In FIGS. 5 and 6 a modified form of upper casing 210, for housing 209, is shown. This upper casing 210 forms an upper separation zone 222*a* and a portion of upper hopper 26*a* as defined by a cylindrical upper side wall 214 having flange 216 and a conical top wall 215 closed at its apex. A tube 239*c* passes through the apex of wall 215 so that air is withdrawn via aspirator 239, and fed to discharge conduit 235.

The deflector 220 is attached to lower housing portion of casing 11 as previously described and is disposed within wall 214 and comprises a frusto-conical skirt 223 and, at its upper end, a cylindrical neck 221, through which discharge conduit 235 passes unattached by way of upper end open U-shaped recess 221*c*. Neck 221 and wall 214 are concentric about vertical axis α. Flat, circumferentially evenly spaced, radially disposed, vertical baffles or paddles 230, which are attached to deflector 220, extend to inner surface of wall 14 to which they are unattached.

A straight tubular intake conduit 233 extends tangentially through the upper peripheral portion of wall 214, adjacent its top wall 15 for discharging the slurry in a tangential horizontal direction along the inside periphery of wall 214. Conduit 233 has an inwardly beveled discharge mouth 232.

The baffles 230 are disposed vertically below both the discharge mouth 232 and the upper lip or rim 221*a*.

That portion of the system, not shown in FIGS. 5 and 6 is identical to the system previously described.

The discharge of slurry through pipe 233 and into the upper casing 210 of the housing 209, creates a whirlpool flow spiraling inwardly to the opening between wall 15 and the lip or upper edge 221*a*, as indicated by arrows in FIG. 6. This flow in the uppermost unobstructed zone of casing 210 is, itself, essentially unobstructed and, hence, the particulate material is thrown outwardly by centrifugal force, toward wall 314, and to a gravitational fallout into the first stage upper hopper 26*a*.

The radially extending vanes or baffles 230, which are below the unobstructed zone, tend to arrest this swirling whirlpool motion below the baffles. Between the unobstructed zone and the upper edge of the baffles 230, some eddy currents are created which in themselves, create centrifugal forces tending to separate the particulate material from suspension. Within the area of the baffles 230, and below, the liquid flow path is substantially eliminated and thus permits settling of the particulate material onto skirt 223 in a manner previously described into the upper particulates hopper 26*a*.

Figure 7:
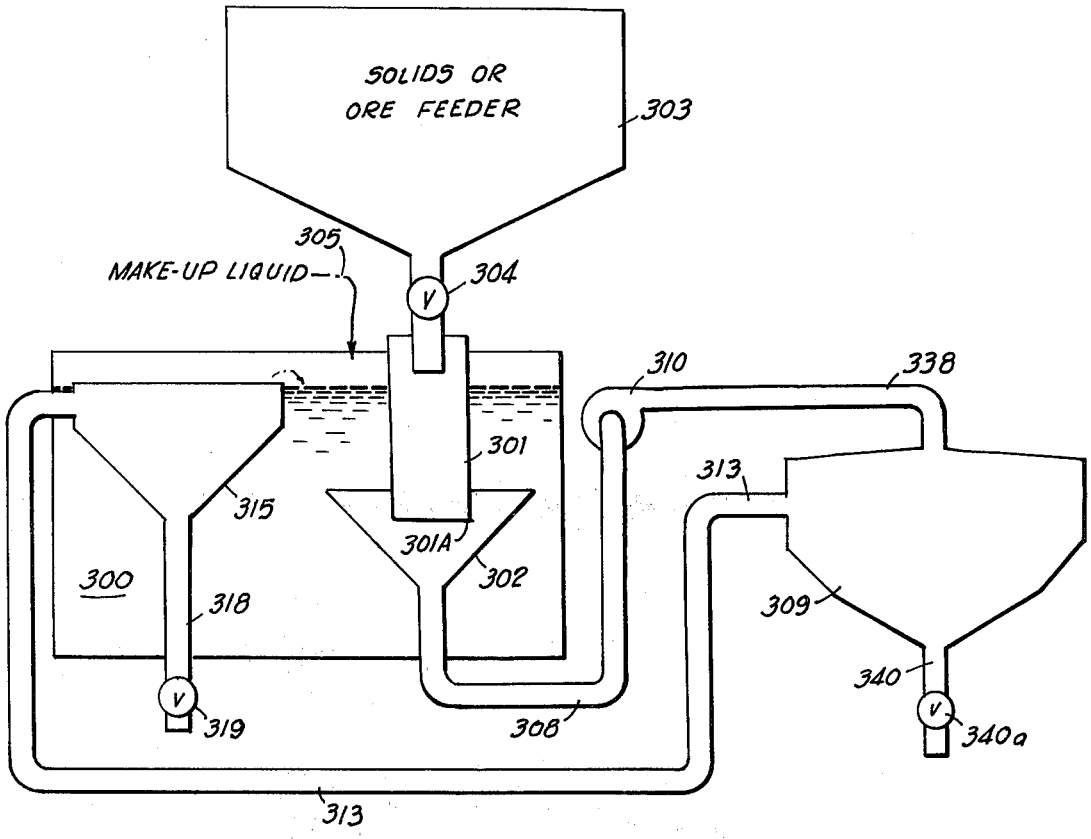
FIG. 7 is a schematic diagram showing the use of the apparatus of the present invention in a closed system.
Figure 8:
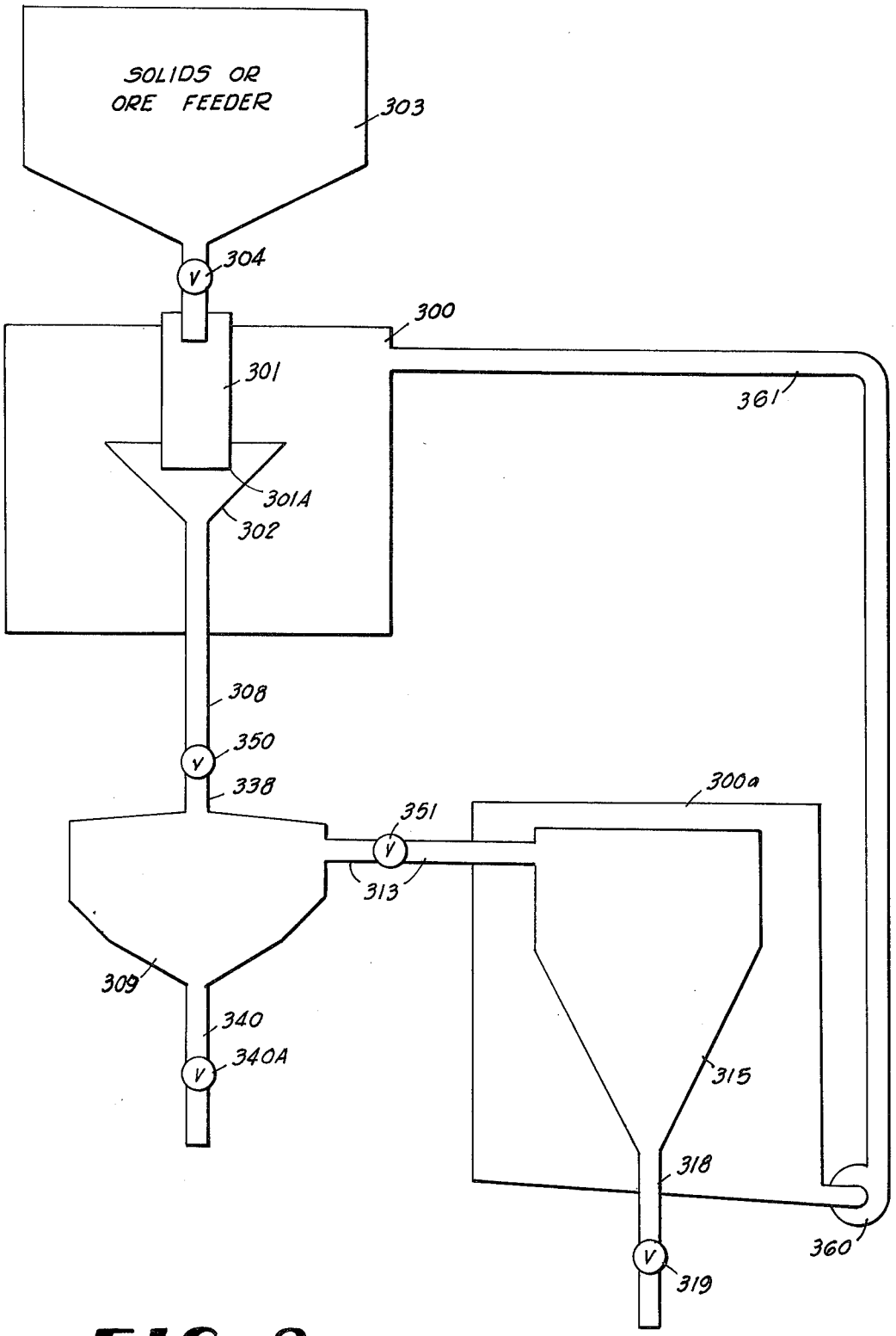
FIG. 8 is a schematic diagram of the present invention in a gravity operated mode.

In FIG. 7, a closed system is illustrated. In this system a closed liquid tank 300 carries a solids input spout or collar 301 to which solids (particulate material) are fed via gravity from solids or ore feeder 303 through valve 304. The lower open end 301*a* of collar 301 terminates within a funnel shaped mixing hopper 302 disposed below the normal liquid level L in the tank 300. The mixing hopper 302 feeds the slurry of solids (particulate material) and liquid, via pipe 308 and pump 310 to the intake conduit 338 of the housing 309.

The effluent from the lower casing 11 is fed via pipe 313 to the top of a cyclone separator 315 where the solids are separate from the liquid and these solids are discharged, via pipe 318 and valve 319 as waste.

The separator 315 is within tank 300, as illustrated, so that the liquid will spill over the rim or lip of separator 315 into tank 300. Make-up liquid is fed to the tank 300, via pipe 305 to maintain the level L.

Mixing, in the closed system of FIG. 7 is automatically accomplished due to the circulation of the liquid and its progressive entrainment of the solids as the liquid flows into mixing hopper 302. The flow rate of the circulating liquid and the feed rate of the solids will determine the makeup of the resulting slurry.

In FIG. 8 a system is illustrated, a system similar to that shown in FIG. 7, but instead of pump 310 providing the force to transport the fluid and solids through the process circuit as shown in FIG. 7, in FIG. 8 gravity is used as the transporting force. The housing 309 is placed so that the fluid will flow by gravity from liquid tank 300 through the housing 309 and into a second liquid tank 300*a*. Many process units can be connected to common liquid tanks such as ten to fifty, or more units, all deriving their liquid from liquid tank 300 and then depositing their liquid into the second liquid tank 300*a* where a single pump, such as pump 360, recycles the liquid back into the first liquid tank 300. Valves 350 and 351 regulate liquid flow rate.

In FIG. 9 a system is illustrated which is operated either as shown in FIG. 7 or FIG. 8 but having the process housing 409 mounted on a spring 472 in frame 473 so as to have vertical compliance which will respond to the varying total weight of the housing 409 and its contents with a direct mechanical coupling through lever 475 to the valve 404 of solids or ore feeder 403 to govern the solids input into the process circuit including tank 400, collar 401, mixing hopper 402, end 401*a* and pump 410, all similar to the corresponding elements of FIGS. 7 and 8.

OPERATION

From the foregoing description, the operation of the present system should be apparent. In FIG. 1, it will be understood that the slurry of liquid or gas and finally divided particulate material, such as gold ore, is fed into conduit 33 and thence passes into the upper chamber 22*a* traveling in a torical path outwardly.

The function of upper chamber 22*a* is to separate the bulk of particulate material carried into housing 9 from the liquid carrier and thus separate the particulate material flow path from the liquid flow path through the area of the process circuit where the relatively heavy and relatively light particulate constituents are separated to be discharged separately. Another function of upper chamber 22a is to provide a particulate material feed hopper 26a, which is directly coupled and coactive with a lower particulate material hopper 26b in lower chamber 22b. Lower hopper 26b is the major work area of the process circuit for the selective separation and discharge of the particulate material. In this first stage upper chamber 22a, two forces coact for the removal of the particulate material from suspension in the liquid flow path. First, the centrifugal action of the torical path causes the particulate material to be thrown out toward the wall 14 while the movement from a restricted path such as conduit 33 into a substantially larger area of the chamber 22a causes a reduction in the velocity of the slurry, thereby permitting the particulate material to settle out and collect in the first stage upper particulate material hopper 26a.

With the use of sensors 54 and 55 located in the first stage hopper 26a portion of upper chamber 22a, or other means herein described, a prescribed level of particulate material is maintained in the upper particulate material hopper 26a. Sensor 55 monitors the lower level to insure sufficient accumulation to block annular passageway 25 to liquid flow while sensor 54 monitors the upper level to insure that no particulate material will overflow into central liquid passageway 21d. Should excessive particulate material be collected in upper particulate material hopper 26a, and thus build up to sensor 54, sensor 54 will indicate a change in resistance between elements 54a and 54b and thereby signal through an appropriate control 47a the operation of valve 304 so as to restrict the flow of particulate material into housing 9, until the level of particulate material has reached the sensor 55. The sensor 55 then signals through control 47a that valve 304 is to again open.

With the conditions as described the entire liquid flow path through the process circuit can be traced as follows: The liquid enters the housing 9 through conduit 33 and thence passes into the upper chamber 22a traveling in a torical path outwardly and then inwardly, and having dropped the bulk of any particulate material it carries into housing 9, it is then directed to central passageway 21d, since annular passageway 25 is blocked to liquid flow. The liquid flow path is then directed down through the central liquid passageway 21d, of the neck 21 and skirt 23 of deflector 20, into recess 46, which is the area of reunion with the particulate material; it then makes an abrupt 180° turn to enter, upwardly, into the mouth 36 of conduit 33 and thus discharged to complete its flow path through housing 9.

The particulate material flow path through the process circuit is traced as follows: The particulate material is carried into housing 9 in a slurry by conduit 33 and thence passes into the upper chamber 22a, traveling in a torical path outwardly, and is caused to fall from suspension from the liquid carrier flow path as previously described, and thus begins the gravity directed portion of the particulate material flow path through the process circuit. It then settles out and collects in the first stage upper particulate material hopper 26a. The first stage upper particulate material hopper 26a is stacked above and is directly coupled by way of annular passageway 25 to the lower particulate material hopper 26b in lower chamber 22b. Continuing its gravity directed portion of its flow path through the process circuit, which is isolated from the liquid flow path, the particulate material passes through annular passageway 25 into lower particulate material hopper 26b.

It will be remembered that the housing, namely the upper casing 10 and the lower casing 11, are simultaneously rocked or oscillated back and forth about axis $\alpha$ and hence riffles 60a, located in the area of lower particulate material hopper 26b, are moved back and forth in an oscillatory action which causes the particulate material in this area to be stratified according to relative weight and also it is a controllable stimulation to the gravity induced flow rate of the particulate material through lower particulate material hopper 26b.

The particulate material completes its flow path through the process circuit by way of either of two exits from the lower particulate material hopper 26b which are located on its inner boundary. A discharge means from the lowermost strata of particulate material from the lower hopper 26b, which would be the relatively heavier constituents, is passageway 49 to particulates discharge port 18a with the output controlled by valve 40a. A discharge means from the uppermost strata of particulate material from lower hopper 26b, which would be the relatively lighter constituents, is spillway lip 45 over which the lighter constituents overflow into recess 46 where they are then reunited with the liquid flow path and discharged through conduit 35.

Isolated from the liquid flow path and thus unaffected by the liquid flow rate, the flow of particulate material through lower hopper 26b has both a coarse and fine adjustment. It will be remembered that deflector 20 can be raised or lowered by adjustment screws 28 and thus changing the descent angle between annular passageway 25 to spillway lip 45. This function provides a coarse adjustment for the particulate material flow rate while oscillation or agitation has a leveling effect on the particulate material stimulating gravity induced flow and thus provides a fine adjustment of the particulate material flow rate through the lower hopper 26b as it moves from the relatively elevated annular passageway 25 to spillway lip 45. Through these combined functions exposure time of the transient particulate material through lower hopper 26b can be regulated to allow the solid particles of various specific densities to stratify causing the relatively lighter constituent to be directed to the uppermost strata discharge means, past spillway lip 45, and directing the relatively heavier constituents to lower strata discharge means through passageway 49.

As particulate material passes through lower hopper 26b pass overflow spillway lip 45, the uppermost strata discharge means, and through lowermost strata discharge means, passageway 49 through particulate material discharge port 18a and through controlled particulate material discharge valve 40a, regulating the amount of particulate material output by valve 40a will determine the proportional division and discharge from the uppermost strata and from the lowermost strata of the particulate material being processed.

With the first stage particulate hopper 26a over the second stage particulate hopper 26b, the amount of particulate material transferred from the hopper 26a to the hopper 26b is automatically regulated. In other words, a fully filled second stage hopper 26b will block additional particulate material from the first stage hopper 26a from flowing into hopper 26b through the annular passageway 25. Hence, the amount of particulate material withdrawn through the valve 40a and discharged past spillway lip 45 has a direct relationship to the amount of material passing through the annular passageway 25.

Particulate material of various specific densities may be transported in a fluidic medium into the apparatus for separation and concentration of the relatively heavier particulate material. This may be done with the water-tight apparatus submerged over a sea bed, in placer mining, upon land, or even upon extra-terrestial bodies. For example, gold or other heavy minerals may be recovered through its use by transporting heavy mineral bearing particulate material intermixed with gravel with a mixture of sea water and undissolved air into the apparatus with effective application of the process extending into a very fine particle size range substantially below a minus 200 mesh size which is a size range normally beyond commerical application of gravity mineral beneficiation devices. The material may be forced through the fluid-tight housing by motor means (pump 310) either pushing the material through the intake conduit or motor means pulling the material through the outlet conduit or simply by force of gravity alone as illustrated in FIG. 8.

The oscillation of the housing by the rod 74 is usually accomplished with the rod 74 travelling less than one inch. Fine adjustment of the system is accomplished by increasing or decreasing the amount of agitation or oscillation of the housing 9. Fine adjustment is also accomplished by increasing or decreasng the flow rate of the liquid. Course adjustment is accomplished by manipulation of bolts 28. These fine adjustments can be automated to make corrections in response to a feedback signal derived from monitoring the outputs of the system and thereby obtain an ideal balance between process recovery efficiency and process capacity.

Through the system thus described the objects of the present invention are achieved. For example, the mechanism of the present invention may be operated totally submerged in sea water with a pump picking up a mixture of sea water and bottom solids from an ocean floor and feeding this slurry through conduit 38 to the housing 9. The discharge from conduit 40 can be fed to a surface ship.

The gases are continuously purged from the system by aspirator 39. The sensors 48, 54 and 55 control the operation of the system continuously by detecting the conditions within the system, or functions of sensors 54 and 55 can be substituted by stress gauges or by mounting the housing 9 to have vertical compliance with a direct mechanical coupling to particulate material input valve 304.

The system is also free of any fixed enrichment ratio, so that it may be operated where the slurry has only a small percentage of heavy constituents or a very large percentage of heavy constituents. This is accomplished with the use of valve **40*a*** which allows the relatively heavier constituents to reach a predetermined level of concentration before being discharged.

The system separates the liquid flow path from the particulate material flow path through the process circuit and provides means to independently regulate the flow rates of the liquid and particulate material.

With both coarse and fine adjustable means the flow rate of particulate material can be regulated to determine the exposure time of the particulate material as it passes through lower hopper **26*b***.

By separating the liquid and particulate material flow paths the system also eliminates restriction to a single and combined flow rate and flow path for both the liquid and particulate material found in prior gravity type mineral beneficiation devices.

The system also eliminates surface turbulence such as that generated in the open trough devices with their inseparable liquid and particulate material flow paths. Such surface turbulence is eliminated by isolating the particulate material flow path through lower hopper **26*b*** from the liquid flow path, with another contributing factor, the closed chamber technique, providing smooth laminar flow conditions through the process circuit.

With upper hopper **26*a* directly coupled by passageway 25 to lower hopper 26*b*, which is the major area of particulates selective separation, particulate material transferred from the upper hopper into the lower hopper is automatic and contingent to exposure time of particulate material as it passes through lower hopper 26*b***.

Controlling the output from lower hopper **26*b* with valve 40*a*** provides a readily adjustable means for the proportional division and discharge from the uppermost strata and from the lowermost strate of the particulate material being processed.

The system eliminates any middlings product by having only two exits from lower hopper **26*b*** so that the particulate material is worked and exposed to stratification oeration until it is separated to be discharged as either valuable concentrate or waste product.

The system also eliminates feed density as a factor in process efficiency. Unlike prior devices where the liquid and particulate material follow a common flow path past the area of selective separation in their process circuit, with feed density a critical factor in process efficiency, with the system herein described the work area lower hopper **26*b* is isolated from the liquid flow path by, and directly fed from, upper hopper 26*a*** eliminating completing feed density as a factor in process efficiency.

The system can be automated and set to automatically determine and maintain maximum capacity in response to feedback signals derived from the outputs of the system to regulate the liquid flow rate and particulate material exposure time (flow rate) to achieve the desired balance between process efficiency and process capacity.

The system can also be operated with a centrifugal cyclone type of particulate material delivered into the upper hopper **26*a***.

Compaired to prior devices the system herein described provides a far more linear recovery response through a broader range of particle sizes by reducing or eliminating surface turbulence and restriction to a combined and single flow rate of the liquid and particulate material as found in these prior devices.

The system herein described is also useful in coal preparation for the removal of the relatively heavier deleterious constituents normally found with coal such as pyrite, marcasite and other forms of extraneous or secondary ash.

I claim:

1. Process for the recovery of heavy constituents from particulate material carried in a transporting fluid forming a slurry, comprising:

(a) passing said slurry along a prescribed path;

(b) directing said slurry in a first zone from said prescribed path and thence back toward said path so as to subject the slurry to centrifugal force for progressively throwing certain particulate material out of the path of travel of said slurry;

(c) collecting said particulate material which is thrown out of said slurry and directing the same along a second prescribed path while agitating said particulate material; and (d) collecting the heaviest portion of the agitated particulate material.

2. The process defined in claim 1, wherein said slurry is passed in a torical path when it is directed away from and then back toward said prescribed path.

3. The process defined in claim 1 wherein the velocity of said slurry is reduced during the period in which it is directed out of said prescribed path and thence back toward said prescribed path.

4. The process defined in claim 1 wherein said prescribed path is in a downward direction, and the path in which the slurry is subjected to centrifugal force is a torical path outwardly from said prescribed path.

5. The process defined in claim 1 wherein the second prescribed path is a downwardly converging path in which said particulate material is agitated and wherein the heavier portion of the said particulate material accumulate at the apex of the downwardly converging path.

6. The process defined in claim 1 wherein the transporting fluid of said slurry, after being directed back toward said prescribed path, is subjected in a second zone to further centrifugal force which removes additional particulate material therefrom.

7. The process defined in claim 6 wherein a light portion of particulate material is entrained by said transporting fluid in said second zone, and both said transporting fluid and said light portion are discharged from said second zone.

8. The process defined in claim 7 wherein the separated heavier portion of said particulate material is continuously directed along a discharge path.

9. The process defined in claim 1 wherein said second prescribed path is a downwardly converging path for causing the heaviest portion of the particulate material to accumulate at the apex of the converging path.

10. In a process for the recovery of heavy constituents from particulate material carried in a transportation fluid for forming a slurry, the steps of:

(a) moving said slurry along a prescribed path and separating the particulate material from its transporting fluid;

(b) receiving said particulate material on a downwardly inclined surface;

(c) disposing a block having a lip and a recess over said surface;

(d) passing said transporting fluid over said block; and (e) moving said particulate material inwardly and downwardly on said surface for causing the heavy portion of said particulate material to be directed toward the lowermost portion of said surface and the lighter portion to flow over said lip and be entrained by said transportation fluid.

11. The process defined in claim 10 wherein the step of moving said particulate material includes agitating said inclined surface to stratify said particulate material.

12. The process defined in claim 11 wherein said inclined surface is a downwardly converging surface converging toward a vertical axis.

13. The process defined in claim 12 wherein said lip is an upstanding ring concentrically surrounding said vertical axis, said block being spaced above said converging surface, and wherein the step of moving said surface includes rocking simultaneously both said block and said converging surface about said vertical axis.

14. The process defined in claim 13 wherein the step of separating the particulate material from its transportation fluid includes the steps of subjecting said slurry to centrifugal force above said block and thereafter progressively depositing said particulate material in a ring around and spaced from said block.

15. The process defined in claim 14 wherein the particulate material which is deposited in a ring is progressively directed in said downwardly converging path while the lighter portions thereof pass over said lip progressively and thereafter are entrained and removed by the transportation fluid.

16. The process defined in claim 10 including supplying additional particulate material to said transportation fluid to form additional slurry and repeating the processing thereof.

17. The process defined in claim 16 including the steps of monitoring the collection of said particulate material in said ring and regulating the volume of slurry being subjected to the process in response thereto.

18. The process defined in claim 17 including the steps of monitoring the accumulation of the particulate material on said surface and regulating the rate of withdrawal of said heavy portion from a lowermost portion of the downwardly converging path in response thereto.

19. Process for the recovery of heavy constituents from particulate material carried in a fluid slurry, comprising:

(a) passing a flow of said slurry along a prescribed path;

(b) separating the particulate material from the transportation fluid of said slurry in a first separation zone along said path;

(c) accumulating said particulate material in a first accumulation zone;

(e) measuring the accumulation of said particulate material in said first accumulation zone and regulating the flow of said slurry along said path in response thereto;

(f) passing said particulate material along a second prescribed path;

(g) stratifying said particulate material as it is moved along said second path; and (h) removing a light portion from said particulate material as it is moved along said second path.

20. The process defined in claim 19 wherein said second path includes a downwardly converging path and the removing of the light portion is achieved at a position outwardly of the apex of the downwardly converging path.

21. The process defined in claim 19 wherein said step of separating said particulate material from said slurry includes passing such slurry along a torical path and separating the particulate material by centrifugal force from said slurry.

22. The process defined in claim 19 wherein said step of separating said particulate material from said slurry includes subjecting such slurry to centrifugal force and to a reduction in velocity so as to separate by centrifugal force and by sedimentation the particulate material from said slurry above said second prescribed path.

23. The process defined in claim 19 wherein the step of removing the light portion of said particulate material includes passing the transportation fluid from which said particulate material has been removed in a downward path toward said second path and then altering the path of movement of said transportation fluid to an upward path so as to entrain said light portion.

24. The process defined in claim 23 wherein the separated particulate material is subjected to agitation in said second path so as to urge the light portions thereof upwardly.

25. Apparatus for separating particulate materials of various specific densities carried in a fluid slurry comprising a substantially fluid-tight housing defining a chamber and having a discharge port and an interior floor sloping towards said discharge port, a deflector mounted within said housing with its lower edge spaced from said housing interior floor for defining a generally annular passageway, said deflector separating the chamber of said housing into an upper zone and a lower zone, an intake conduit through which materials is introduced into said upper zone, an outlet conduit through which materials is discharged from a space within said lower zone and a recess defining member mounted within said lower zone, said member having a generally annular lip located adjacent to the entrance of said discharge conduit.

26. Apparatus in accordance with claim 25 wherein the upper edge of said lip is located above the mouth of said discharge conduit.

27. Apparatus in accordance with claim 25 wherein said upper edge of said lip is located at an elevation approximaterly equal to the elevation of the lower edge of said deflector.

28. Apparatus in accordance with claim 25 including means for imparting centrifugal force to the slurry introduced into said upper zone through said intake conduit.

29. Apparatus in accordance with claim 25 including means for altering the position of said deflector in said housing for varying the relative position of said annular passageway.

30. Apparatus in accordance with claim 25 including a baffle supported within said upper zone adjacent to the mouth of said intake conduit for diverting the path of slurry passing into said upper zone, said deflector having a central passageway through which slurry from said upper zone passes into said lower zone.

31. Apparatus in accordance with claim 25 including means for rocking said housing and said recess defining member about a vertical axis.

32. Apparatus for separating the heavy constituents of particulate material carried in a fluid slurry comprising:

(a) a housing defining a chamber;

(b) a deflector disposed within said housing for separating said housing into an upper zone and a lower zone, said deflector defining a peripheral opening and a central opening:

(c) an intake conduit for introducing said slurry into said upper zone;

(d) means for imparting centrifugal force to the slurry introduced into said upper zone for diverting the particulate material toward said peripheral opening;

(e) a discharge conduit having a mouth within said lower zone for removing the slurry from said lower zone; and (f) a recess defining member having a recess adjacent to said mouth of said discharge conduit in said lower zone.

33. The apparatus defined in claim 32 wherein said means for imparting centrifugal force to said slurry includes a baffle disposed between the discharge end of said intake conduit and the central opening of siad deflector.

34. The apparatus defined in claim 32 wherein said discharge conduit is disposed centrally within said chamber with its mouth opening downwardly into the central portion of said recess and wherein said conduit passes outwardly through said housing.

35. The apparatus defined in claim 34 including means for vibrating said housing and said receptacle defining member.

36. The apparatus defined in claim 32 including means for recirculating said slurry from said discharge conduit to said intake conduit and for introducing additional particulate material into said slurry during the recirculation thereof.

37. The apparatus defined in claim 32 including means for incrementally adjusting the postion of said deflector.

38. The apparatus defined in claim 32 including an aspirator connected between the upper portion of said upper zone and said discharge conduit, said aspirator removing the air from said upper zone and entraining there in the slurry being discharged through said discharge conduit.

39. The apparatus defined in claim 32 wherein said housing is disposed along a vertical axis and said recess defining means is disposed along said vertical axis and including means for reciprocating siad housing and said recess receiving means about said vertical axis.

40. The apparatus defined in claim 32 wherein said deflector includes a conical upwardly converging skirt, the upper end portion is provided with said central opening and wherein said peripheral opening is defined by the lower edge of said skirt and the inner surface of said housing.

41. The apparatus defined in claim 32 wherein said housing includes a downwardly converging bottom surface and including a plurality of radially extending riffles projecting along said surface between said recess defining means and said surface.

42. The apparatus defined in claim 32 including means for detecting the accumulation of particulate material in the vicinity of said peripheral opening and for regulating the feed of slurry into said upper zone in accordance with the said accumulation.

43. The apparatus defined in claim 32 wherein said chamber has a cylindrical side wall and wherein said intake conduit projects through said side wall for introducing said slurry tangentially into said chamber.

44. The apparatus defined in claim 43 including a plurality of baffles disposed in the central portion of said chamber for arresting the circular motion of said slurry.

45. The apparatus defined in claim 44 wherein said baffles are secured by their inner end to said deflector and extend radially outwardly therefrom.

46. In an apparatus for separating the heavy particulate material from a fluid slurry:

(a) a housing defining an essentially closed chamber having a generally cylindrical side wall;

(b) intake means for introducing said fluid slurry tangentially into said chamber so that it moves in a circular path within the upper portion of said chamber to discharge said particulate material outward by centrifugal force;

(c) baffles disposed within said chamber inwardly of said wall for retarding the circular movement of said slurry to permit settling of said particulate material therefrom;

(d) a fluid passageway inwardly of said baffles for removing the fluid of said slurry;

(e) deflector means for directing the particulate material thrown out of said fluid by centrifugal force and settled out of said fluid into a common path; and (f) means for progressively removing said particulate material from said common path.

47. The apparatus defined in claim 46 wherein said deflector means is a frusto conical skirt within said chamber and below said baffles.

* * * * *